US006179090B1

(12) United States Patent
Casas

(10) Patent No.: US 6,179,090 B1
(45) Date of Patent: Jan. 30, 2001

(54) ELEVATOR HOIST BRAKE RELEASE APPARATUS

(76) Inventor: Alan V. Casas, Box 327, Lake Isabella, CA (US) 93240

( * ) Notice: Under 35 U.S.C. 154(b), the term of this patent shall be extended for 0 days.

(21) Appl. No.: 08/753,190

(22) Filed: Nov. 21, 1996

(51) Int. Cl.[7] ..... B66B 5/16
(52) U.S. Cl. ..... 187/377
(58) Field of Search ..... 187/377, 314, 187/350, 298

(56) References Cited

U.S. PATENT DOCUMENTS

| | | | | |
|---|---|---|---|---|
| 4,923,055 | * | 5/1990 | Holland | 187/109 |
| 5,228,364 | * | 7/1993 | Casas | 81/485 |
| 5,425,435 | * | 6/1995 | Gregory | 188/77 W |
| 5,873,434 | * | 2/1999 | Sugita | 187/288 |
| 5,890,565 | * | 4/1999 | Wang | 187/263 |

* cited by examiner

*Primary Examiner*—Christopher P. Ellis
*Assistant Examiner*—Khoi H. Tran
(74) *Attorney, Agent, or Firm*—Robert M. Sperry

(57) ABSTRACT

Improved means for manually and controllably releasing elevator hoist brakes having brake shoes urgeable into locking position by brake springs, said apparatus comprising a support bar, a first arm mounted adjacent one end of said support bar and carrying first brake release means engageable with one end of said brake springs, a second arm located adjacent the opposite end of said support bar, a compound lever which is generally V-shaped having one elongated leg and one short leg with the short leg being pivotally mounted on said second arm, and a generally L-shaped member having a short leg pivotally mounted adjacent the free end of said second arm and having a long leg pivotally connected to the long leg of said lever, and second brake release means pivotally mounted adjacent the intersection of the legs of said L-shaped member and engageable with the opposite end of said brake springs so that movement of said lever will drive said brake release means toward each other to accomplish controlled movement of said brake against the urging of said springs.

17 Claims, 5 Drawing Sheets

ELEVATOR HOIST BRAKE RELEASE APPARATUS

FIELD OF INVENTION

This invention relates to elevators and is particularly directed to improved apparatus for controllably releasing the hoist brake of an elevator to permit smooth, controlled "drifting" of the elevator to an adjacent floor during power outages, natural disasters and the like.

PRIOR ART

As is well known, passenger elevators are typically raised or lowered by a cable which runs over a pulley located at the top of the elevator shaft. The elevator car is attached to one end of the cable, while a counterweight, equal to the weight of the elevator car plus several passengers, is attached to the opposite end of the cable. The car and counterweight run up and down the shaft on guide rails and an electric motor, needing only enough power to raise the difference in weight between the car and the counterweight, drives the pulley to move the car. When the car is stopped, for example, at a desired floor, a hoist brake acts to hold the car at the desired location. The hoist brake is typically urged on by springs and is released by a solenoid. Thus, a power outage serves to set the brake to safely lock the car wherever it is within the elevator shaft until power is restored. Unfortunately, electrical or power failure prompting this emergency braking action often results in passengers being trapped in the elevator car at a location between floors until rescue personnel can open the shaft doors and reach the elevator car by ropes or ladders or moving another elevator car along side to remove the trapped passengers. However, this involves considerable time and risk for the passengers. Furthermore, such time-consuming rescues require a plurality of rescue personnel and demand that the passengers crawl through a trap door onto the roof of the elevator car in order to reach the ropes or ladders or an adjacent elevator car. However, this may be difficult or impossible for some passengers, especially those who are obese, elderly or handicapped. More importantly, in natural emergencies, it may be a considerable time before a sufficient number of rescue personnel are available to effect such rescues, which are time consuming in themselves. Obviously, the longer the wait for rescue, the greater is the peril from fire, smoke and aftershocks. Furthermore, where the power outage has been caused by an earthquake, there is danger or aftershocks which may dislodge chunks of concrete or other structural material within the elevator shaft, causing increased danger to both the rescuers and to the evacuating passengers. Clearly, it would be desirable to provide apparatus which would enable a single individual to effect a controlled release of the hoist brake to facilitate prompt rescue of trapped passengers. Apparatus for accomplishing one man release and control of elevator hoist brakes have been proposed heretofore. However, prior art elevator hoist brake release devices serve to fully release the elevator brake, allowing the car to "drift" uncontrollably and at constantly increasing speeds, which are difficult to stop and which actually increase the danger to the passengers. Thus, none of the prior art elevator brake release devices have been entirely satisfactory.

BRIEF SUMMARY AND OBJECTS OF INVENTION

These disadvantages of the prior art are overcome with the present invention and an improved elevator hoist brake release and control device is proposed which is simple and inexpensive to produce and purchase, yet which enables a single individual to quickly and easily release an elevator hoist brake in a controlled manner to permit safely "drifting" the elevator car in a controlled, constant and predictable manner to an adjacent floor to allow trapped passenger to escape.

The advantages of the present invention are preferably attained by providing improved apparatus for manually releasing and controlling an elevator hoist brake having brake shoes urgeable into locking position by brake springs, said apparatus comprising a support bar, a first arm mounted adjacent one end of said support bar and carrying first brake release means engageable with one end of said brake springs, a second arm located adjacent the opposite end of said support bar, a compound lever which is generally V-shaped having one elongated leg and one short leg with the short leg being pivotally mounted on said second arm, and a generally L-shaped member having a short leg pivotally mounted adjacent the free end of said second arm and having a long leg pivotally connected to the long leg of said lever, and second brake release means pivotally mounted adjacent the intersection of the legs of said L-shaped member and engageable with the opposite end of said brake springs so that movement of said lever will drive said brake release means toward each other to accomplish controlled movement of said brake against the urging of said springs.

Accordingly, it is an object of the present invention to provide improved apparatus for releasing and controlling elevator hoist brakes.

Another object of the present invention is to provide improved means for manually releasing and controlling elevator hoist brakes.

An additional object of the present invention is to provide improved means for manually releasing and controlling elevator hoist brakes which can be actuated by a single individual.

A further object of the present invention is to provide improved means for manually releasing and controlling elevator hoist brakes which is simple and inexpensive to produce and purchase.

Another object of the present invention is to provide improved means for manually releasing and controlling elevator hoist brakes which enables a single individual to quickly and easily release an elevator hoist brake in a controlled manner to permit safely "drifting" the elevator car to an adjacent floor to allow trapped passenger to escape.

A specific object of the present invention is to provide improved means for manually releasing and controlling elevator hoist brakes having brake shoes urgeable into locking position by brake springs, said apparatus comprising a support bar, a first arm mounted adjacent one end of said support bar and carrying first brake release means engageable with one end of said brake springs, a second arm located adjacent the opposite end of said support bar, a compound lever which is generally V-shaped having one elongated leg and one short leg with the short leg being pivotally mounted on said second arm, and a generally L-shaped member having a short leg pivotally mounted adjacent the free end of said second arm and having a long leg pivotally connected to the long leg of said lever, and second brake release means pivotally mounted adjacent the intersection of the legs of said L-shaped member and engageable with the opposite end of said brake springs so that movement of said lever will drive said brake release means toward each other to accomplish controlled movement of said brake against the urging of said springs.

These and other objects and features of the present invention will be apparent from the following detailed description, taken with reference to the figures of the accompanying drawing.

DETAILED DESCRIPTION OF THE INVENTION

Figure 1:
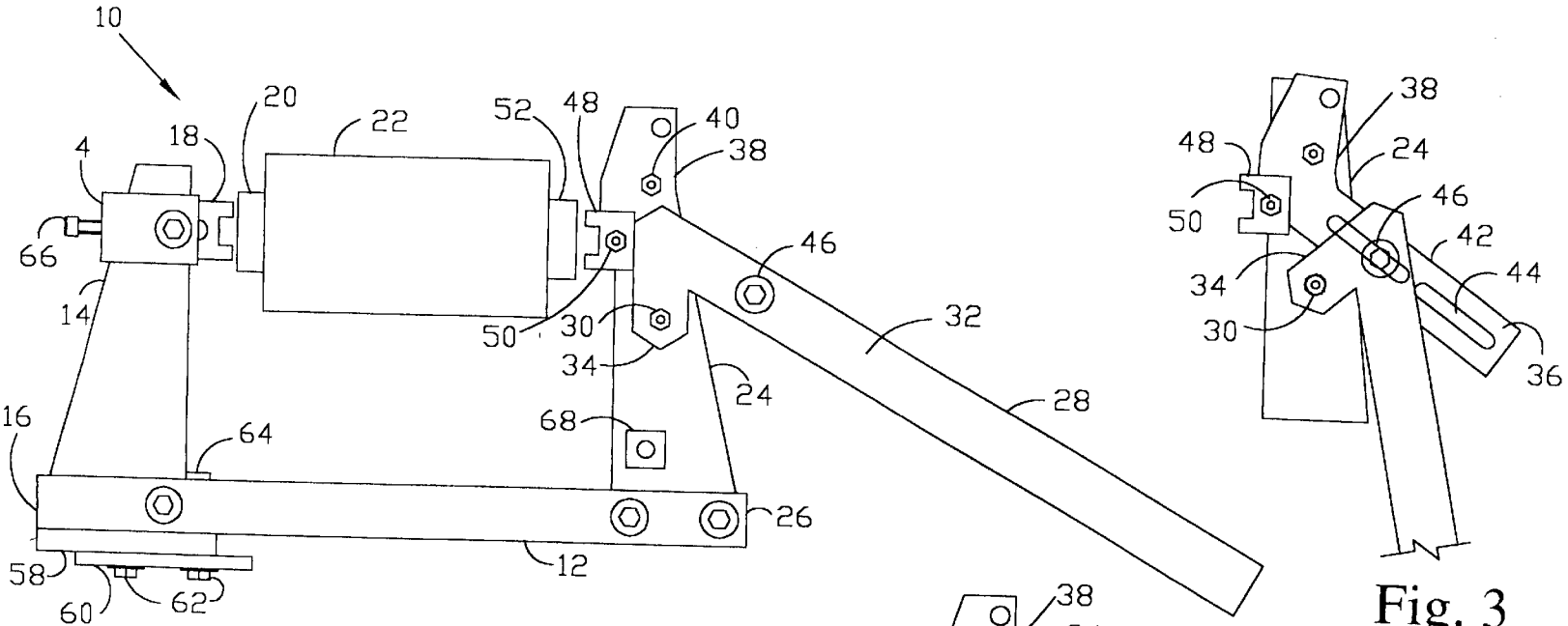
FIG. 1 is a diagrammatic side view of an elevator hoist brake release apparatus embodying the present invention.
Figure 3:
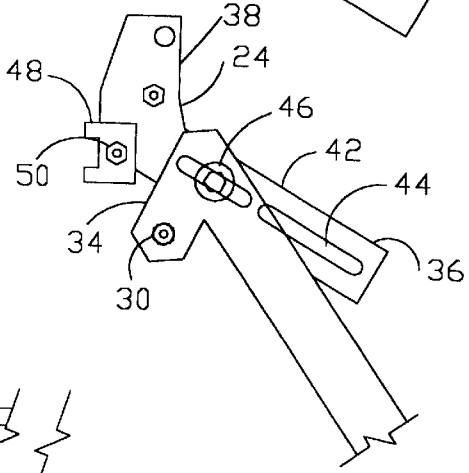
FIG. 3 is a diagrammatic side view of the L-shaped member of the brake release apparatus of FIG. 1.

In that form of the present invention chosen for purposes of illustration in FIG. 1, an elevator brake release and control apparatus, indicated generally at 10, is shown having a support bar 12 with a first arm 14 mounted adjacent one end 16 of said support bar 12 and carrying first brake release means 18 engageable with one end 20 of the elevator brake solenoid 22, a second arm 24 is located adjacent the opposite end 26 of the support bar 12 and a compound lever 28 is pivotally connected to the second arm 24, as seen at 30. It will be understood by those skilled in the art that the elevator brake solenoid, shown at 22 in FIG. 1, is merely a diagrammatic representation and is not intended to be a detailed showing. Thus, in reality, the brake release means 18 and 48 may act upon either the brake solenoid or the coil spring, thus serving to controllably release the brake shoes. As shown, the lever 28 is generally V-shaped having one elongated leg 32 and one short leg 34, with the long leg 32 serving as an actuating handle and the short leg 34 being pivotally mounted at 30 on the second arm 24. The lever 28 actuates a generally L-shaped member 36 having a short leg 38 pivotally mounted adjacent the free end of said second arm 24, as seen at 40, and having a long leg 42 having a slot 44 which is pivotally connected to the long leg 32 of the lever 28, as seen at 46. Second brake release means 48 is pivotally mounted at 50, adjacent the intersection of the legs 38 and 42 of the L-shaped member 36 and is engageable with the opposite end 52 of the brake 22, so that movement of said lever 28 will drive the brake release means 18 and 48 toward each other to accomplish controlled movement of the brake against the urging of the brake engaging springs, not shown.

It is imperative that movement of the L-shaped member 36 be restricted to one side of a line joining the brake release means 18 and 48. This precludes locking the brake shoe out of engagement with the brake drum and makes it impossible to override the deadman fail safe feature common to all elevator hoist machine brakes.

Figure 2:
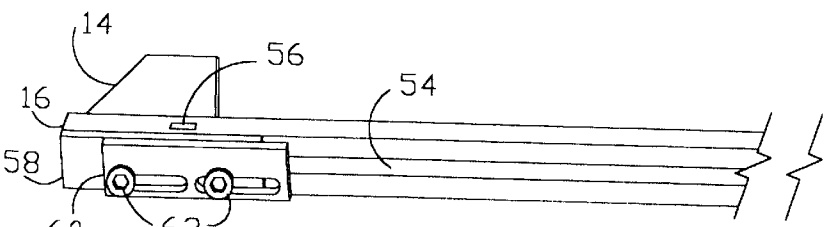
FIG. 2 is a diagrammatic bottom view of the brake release apparatus of FIG. 1.

Preferably, the support bar 12 is formed with a slot 54, extending substantially the entire length of the support bar 12, as best seen in FIG. 2, and first arm 14 extends through the slot 54 and is pivotally secured to the support bar 12 by suitable means, such as bolt 56. Plate 58 is adjustable attached to the support bar 12 and is adjustabl overlapped by by slotted flex stiffener plate 60 and bolts 62 and nuts 64. The flexible attachment of the first arm 14 to the support bar 12 allows adjustable flex movement of the first arm 14 against the flex plate 58 to accommodate different sizes of brake solenoids 22. Moreover, research has shown, as an unexpected result, that this flexibility also serves to provide improved control on the large coil springs of very large hoist machines. The teachings of the present invention include adjusting the dimensions, material or other structural characteristics of the support bar 12 and/or plates 58 and 60, when used with larger springs, to obtain a flexibility that provides maximum control and operational ease by minimizing the abrupt release or resetting of the brake, which would cause erratic operation. This adjustable flexibility facilitates controlled release and reengagement of the hoist brakeand serves to accomodate a variety of hoist springs having different resistances. When a hoist brake is released in normal operation, the brake shoe moves from engagement with the drum to a position typically spaced 1–3 tenths of a millimeter from the drum. When the apparatus of the present invention is used to controllably release the brake, the brake shoe is not disengaged, but the force pressing it against the drum is reduced. The friction therebetween is dynamically controlled to allow the car to safely "drift" in the elevator shaft. It has been found that the flexing of the apparatus significantly improves the operator's control of the dynamic friction between the brake shoe and the drum. Thus, the operator is able to start and stop the elevator car drift more smoothly and to move the car more precisely to a floor level where the trapped passengers may disembark.

Figure 7:
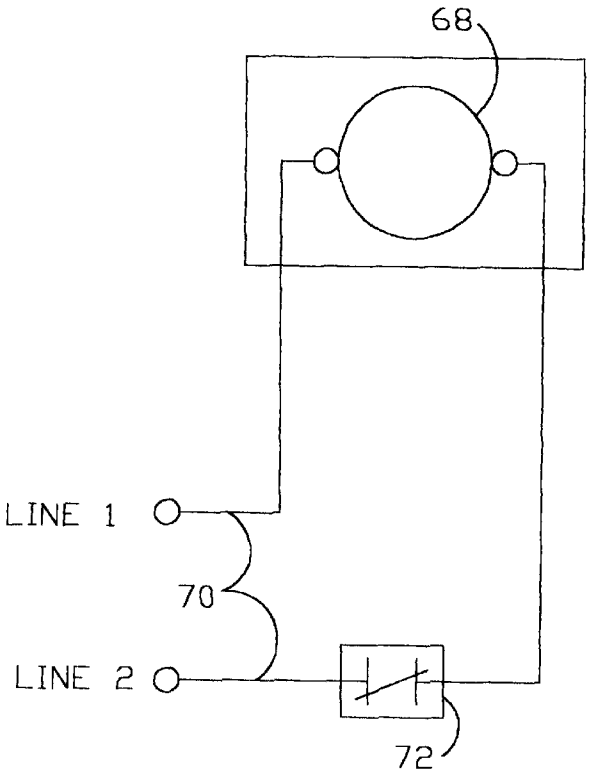
FIG. 7 is an electrical diagram showing an electrical circuit for indicating to the brake release operator whether the elevator gate is open or closed.

Finally, adjustment means, such as screw 66, may be provided for adjusting the position of the brake release means 18 toward or away from end 20 of the elevator brake 22. If desired, audio-visual indicating means 68, such as a lamp, horn or the like, may be mounted in a convenient location on the elevator brake release apparatus 10 and may be connected by electrical circuit 70 FIG. 7 to the elevator car gate switch, indicated diagrammatically at 72 of the elevator car, not shown, to provide an indication to the operator of the elevator brake release and control apparatus 10 if the elevator car gate should become opened.

In use, the operator places the support bar 12 adjacent the elevator brake 22 and adjusts the position of first arm 12, by means of bolts 62, and the position of brake release means 18, by means of screw 66, to cause brake release means 18 and 48 to firmly engage the respective ends 20 and 52 of the elevator brake 22. Thereafter, by pushing the actuating handle 32 inward, the operator causes lever 28 to pivot about point 30, causing pivot 46 to drive the long leg of the L-shaped member 36 to pivot the L-shaped member 36 about pivot point 40, causing the L-shaped member 36 to drive brake release means 48 toward end 52 of the elevator brake 22. This action is also transmitted through second arm 24, support bar 12 and first arm 14 to simultaneously drive brake release member 18 toward end 20 of brake 22, which serves to reduce the friction between the brake shoes and the brake drum, allowing the brake to "slip" in a controlled manner. Due to the mechanical advantage provided by the V-shaped lever 28 and L-shaped member 36, a single operator can easily drive the brake release means 18 and 48 inward to manually control the elevator brake 22 in a carefully controlled manner so as to allow the elevator car to "drift" safely to an adjacent floor where the occupants can easily and safely exit the elevator car. Moreover, the single operator can accomplish this controlled "drifting" quickly and easily in a minimum of time, thereby effecting promt rescue of the trapped passengers and without placing either the passengers or rescuers in a dangerous situation. Obviously, it is potentially dangerous to the passengers if the elevator car should be allowed to "drift" when the elevator car gate is open. However, provision of the audio-visual indicating means 68 serves to provide an immediate indication to the operator of the elevator brake release apparatus 10, if this should occur and avoids the necessity for making a time-consuming floor-by-floor search to ensure that all elevator doors are closed before beginning a "drift".

Figure 4:
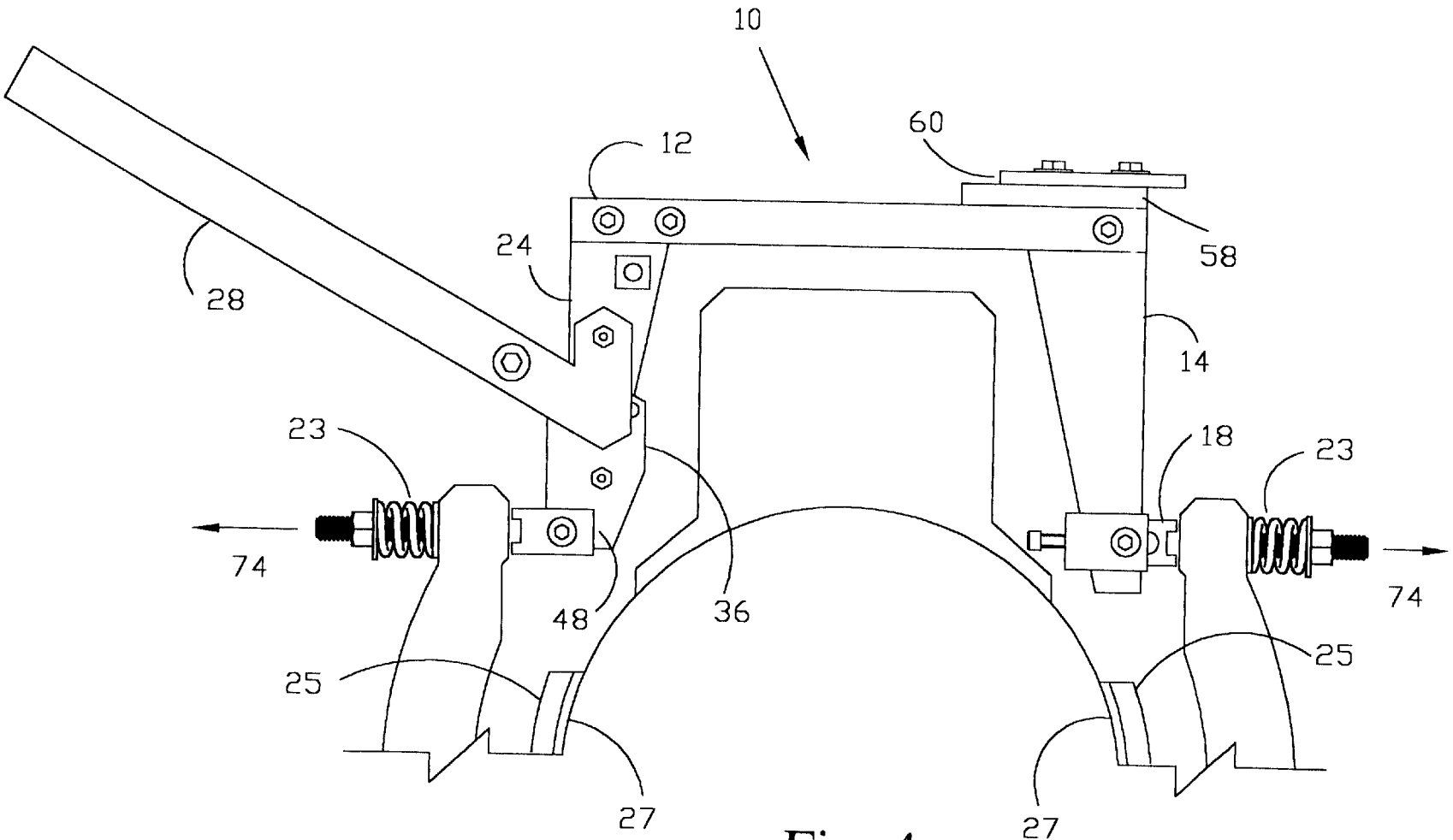
FIG. 4 is a diagrammatic side view of an alternative form of the brake release apparatus of FIG. 1.

FIG. 4 shows an alternative form of the elevator brake release apparatus 10 for a second class of elevators in which flex bars 58 and 60 and the brake release means 18, L-shaped member 36 and the V-shaped lever 28 and the support arm 14 and second arm 24 are mounted inversely to the positions of FIG. 1. This enables the elevator brake release apparatus 10 to press outwardly to accommodate direct engagement against brake coil springs of an inwardly biased elevator brake solenoid, indicated generally at 74. In operation, the brake release members 18 and 48 will be placed in engagement with the respective ends of the elevator brake springs 74 and movement of the lever 28 will cause the L-shaped member 36 to drive the second brake release member 48 outward, thereby driving the ends of the elevator brake solenoid 74 apart to allow "drifting" of the elevator car, not shown.

Figure 5:
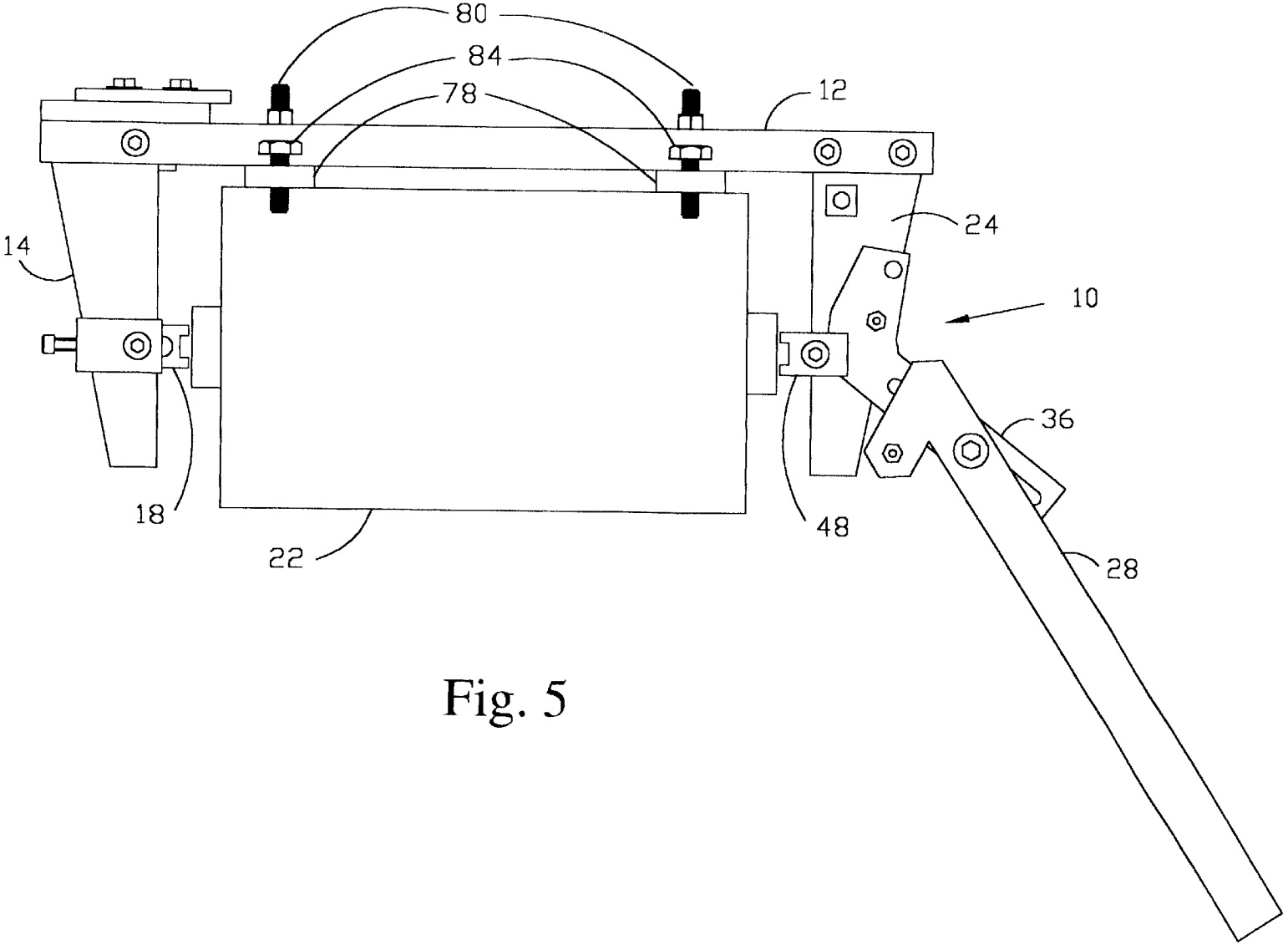
FIG. 5 is a diagrammatic side view showing a mounting plate for mounting the brake release apparatus of FIG. 1 on an elevator brake solenoid.
Figure 6:
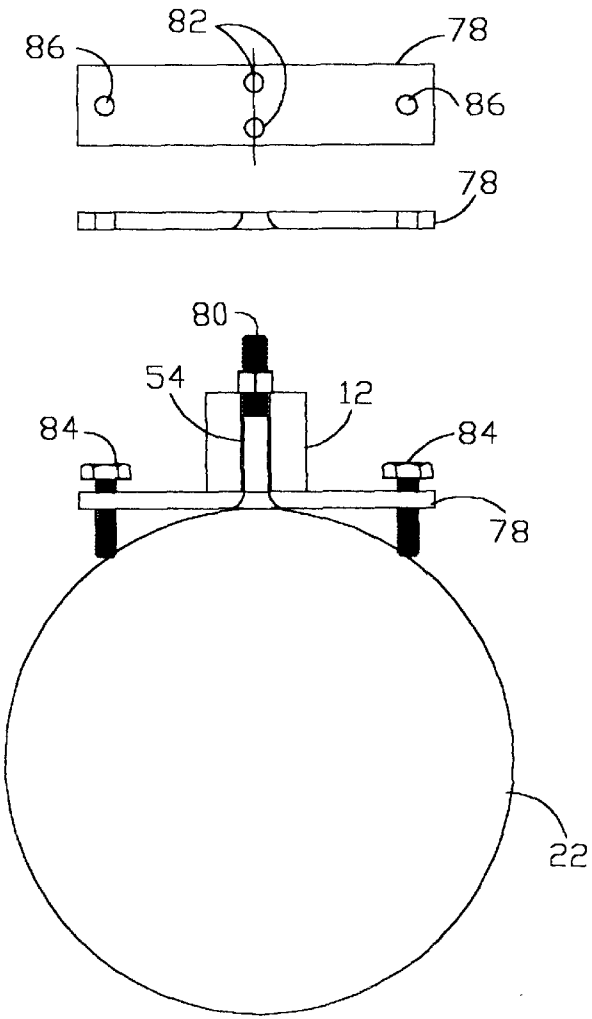
FIG. 6 is a plan view of the mounting plate of FIG. 5, thereafter.
Figure 9:
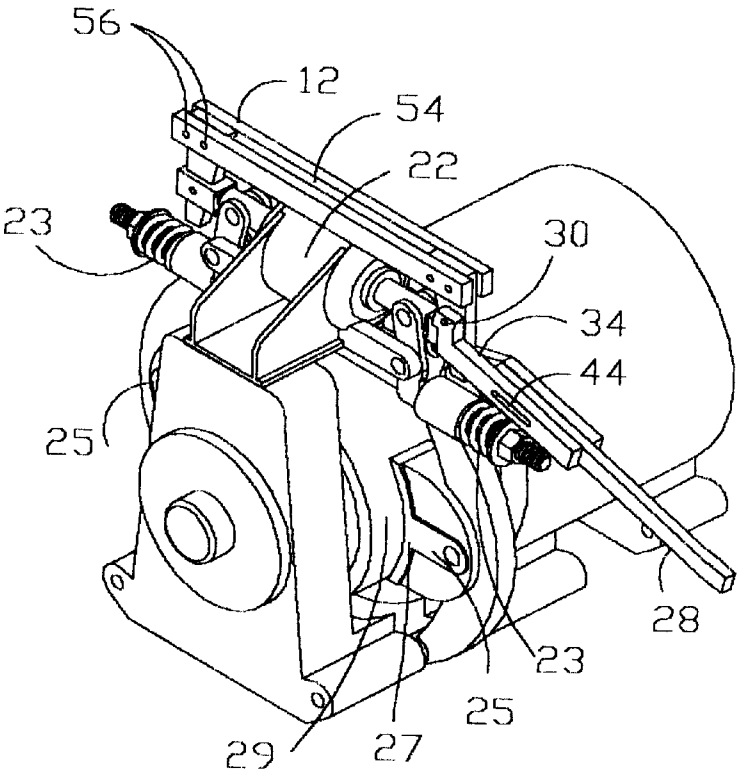
FIG. 9 is an isometric view showing the brake release apparatus of FIG. 8.
Figure 8:
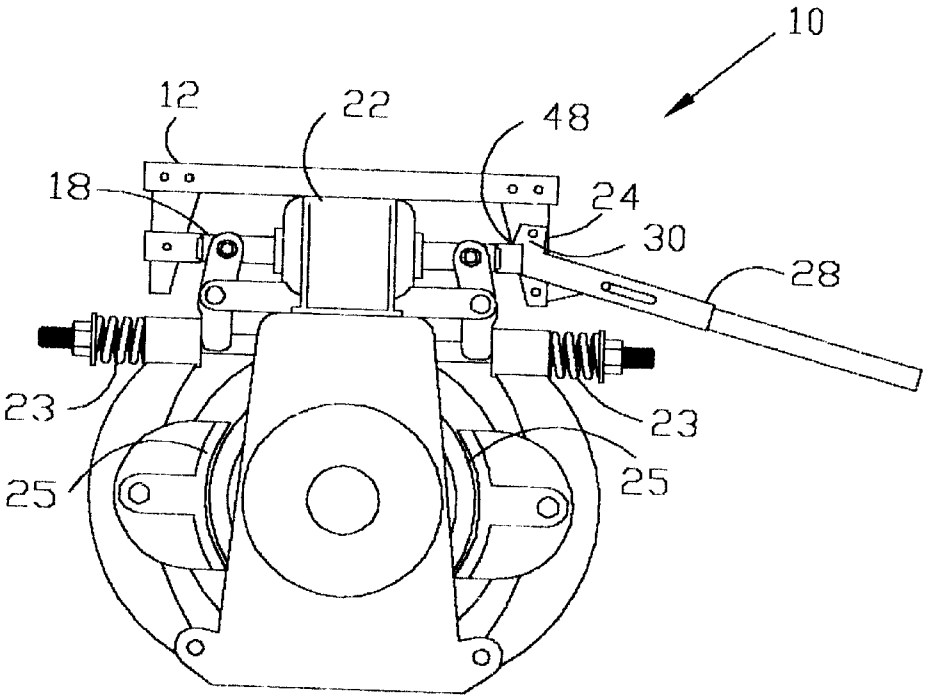
FIG. 8 is a view similar to FIG. 1 showing the elevator brake structure in greater detail.

In some instances, it may be necessary to place the support bar 12 inverted on the elevator brake solenoid 22 and to invert the mounting of the L-shaped member 36 and lever 28 in order to properly position the brake release members 18 and 48. FIGS. 5 and 6 show a mounting plate 78 for accomplishing this. As best seen in FIG. 5, the mounting plate 78 underlies the support bar 12 of the elevator brake release apparatus of FIG. 1 and bolts 80 pass through openings 82 in the plate 78 and through slot 54 of the support bar 12 to releasably secure the plate 78 to the support bar 12 with the plate 78 extending perpendicular to the support bar 12. Bolts 84 extend through threaded openings 86, located adjacent respective ends of the plate 78 to adjustably engage the surface of the elevator brake solenoid 22, to ensure proper orientation of the support bar 12 with respect to the elevator brake solenoid 22.

Obviously, numerous other variations and modifications can be made without departing from the spirit of the present invention. Therefore, it should be clearly understood that the forms of the present invention described above and shown in the figures of the accompanying drawing are illustrative only and are not intended to limit the scope of the present invention.

What is claimed is:

1. Apparatus for manually and controllably releasing elevator hoist brakes having brake shoes urgeable into locking position by brake springs, said apparatus comprising:

a support bar, a first arm mounted adjacent one end of said support bar and carrying first brake release means engageable with one end of said brake springs, a second arm located adjacent the opposite end of said support bar, said second arm having a free end, a lever, a generally L-shaped member having a short leg pivotally mounted adjacent the free end and having a long leg pivotally connected to said lever, and second brake release means pivotally mounted adjacent an intersection of the legs of said L-shaped member and engageable with the opposite end of said brake springs so that movement of said lever will drive said first and second brake release means in a manner to accomplish controlled movement of said brake shoes against the urging of said springs.

2. The apparatus of claim 1 further comprising:

said support bar having a slot extending substantially the entire length of said support bar, said first arm extending through said slot adjacent one end of said support bar and being pivotally secured to said support bar, and means for limiting the pivoting movement of said first arm.

3. The apparatus of claim 2 wherein:

said means for limiting the pivotal movement of said first arm is adjustable.

4. The apparatus of claim 1 wherein:

movement of said lever serves to drive said brake release means toward each other.

5. The apparatus of claim 1 wherein:

movement of said lever serves to drive said brake release means away from each other.

6. The apparatus of claim 1 wherein:

said lever is a compound lever.

7. The apparatus of claim 6 wherein:

Said compound lever is generally V-shaped having one elongated leg and one short leg with the short leg being pivotally mounted on said second arm.

8. The apparatus of claim 7 wherein:

said long leg of said L-shaped member is pivotally connected to said elongated leg of said lever.

9. The apparatus of claim 1 further comprising:

an elongated plate secured to the underside of said support bar and extending perpendicular to said support bar, threaded openings formed adjacent each end of said plate, and bolt means extending through said openings and adjustable to properly position said support bar with respect to the elevator brake solenoid.

10. The Apparatus of claim 1 further comprising:

Means mounted on said apparatus and electrically connected to the elevator car gate switch to indicate to the operator when the elevator car gate is open.

11. The apparatus of claim 1 further comprising:

means restricting movement of said L-shaped member to one side of a line joining said brake release means.

12. The apparatus of claim 1 further comprising:

means for allowing said apparatus to flex prior to movement of said brake springs.

13. Apparatus for releasing an elevator hoist brake having brake shoes responsive to movement of a brake member, said apparatus comprising:

an elongated lever having a first end, a second end, and a pivot axis;

a first jaw portion;

an abutment member having a second jaw portion;

a support member;

means pivoting said elongate lever on said support member about the pivot axis on said elongate lever spaced longitudinally from said first jaw portion;

means mounting said abutment member on said support member in a spaced relation with said elongate lever;

means causing said abutment member to abut one end of said brake member; and means causing said first jaw member to abut the other end of said brake member; whereby movement of the second end of said elongate lever will serve to move the ends of said brake member to release said brake.

14. The apparatus of claim 13 further comprising:

Means for adjusting the space between said abutment member and said elongate lever.

15. The apparatus of claim 13 further comprising:

Means restricting movement of said jaw portion to one side of a line joining said abutment member and said means pivoting said lever.

16. The apparatus of claim 13 wherein:

said support member is made sufficiently flexible to allow the spacing between said abutment member and said means pivoting said lever to increase prior to movement of said brake member.

17. The apparatus of claim 13 wherein:

said support member is made sufficiently flexible to allow the spacing between said abutment member and said means pivoting said lever to increase approximately 6–18 millimeters prior to movement of said brake member.

* * * * *